US005575608A

United States Patent [19]

Yau et al.

[11] Patent Number: 5,575,608

[45] Date of Patent: Nov. 19, 1996

[54] PROTECTIVE SHEATHS FOR FORK LIFT TANGS

[76] Inventors: Luke S. S. Yau, 4626 Wellston Point, San Diego, Calif. 92130; George A. Coonis, 7362 Oleander Ave., Fontana, Calif. 92336

[21] Appl. No.: 638,823

[22] Filed: Apr. 29, 1996

[51] Int. Cl.[6] ..... B66F 9/18

[52] U.S. Cl. ..... 414/607; 414/785

[58] Field of Search ..... 414/607, 785; 187/237

[56] References Cited

U.S. PATENT DOCUMENTS

| | | | |
|---|---|---|---|
| 1,836,576 | 12/1931 | Chalmers | 294/82.1 |
| 2,822,209 | 2/1958 | Cichaczewski | 414/785 |
| 3,758,075 | 9/1973 | Briggs | 414/785 |
| 5,033,933 | 7/1991 | Sinclair et al. | 414/607 |
| 5,221,176 | 6/1993 | Allen et al. | 414/607 |

*Primary Examiner*—Thomas J. Brahan

*Attorney, Agent, or Firm*—John R. Duncan; Frank D. Gilliam

[57] ABSTRACT

A protective sheath for forklift tangs to protect plastic pallets and other structures from impact damage from contact with tang ends. The sheath extends over the tang and carries a bumper at the distal end which abuts the distal end of a tang. The bumper is formed from resilient, energy absorbing material and includes at least two transverse walls generally parallel to the tang end, with a free air space between the members. An insert bonded to the tang that extends into a corresponding sheath recess limits slippage of a pallet on the sheath. A clamp surrounding the proximal end of the sheath and the tang, between two spaced sheath ridges, securely holds the sheath and bumper onto the tang.

13 Claims, 2 Drawing Sheets

PROTECTIVE SHEATHS FOR FORK LIFT TANGS

BACKGROUND OF THE INVENTION

This invention relates to a flexible cover or sheath for fork lift tangs to prevent damage to plastic pallets when engaging, moving and placing them.

Very often, goods in containers such as boxes or bags are mounted on pallets for transportation and storage. The containers are generally secured to the pallets by straps, heavy duty plastic wrap or the like. The palletized containers are generally moved by forklifts.

Originally, pallets were made from two spaced wooden panels spaced apart by approximately 3 ½ inch boards, secured together with nails or screws, so the tangs of a forklift could enter between the panels and lift the pallet and goods mounted thereon. Pallets could be damaged when, in attempting to insert the tangs into the narrow inter-panel space, the relatively sharp tang ends impacted the pallet structure. Damaged wooden pallets could be repaired by replacing damaged parts.

Today, many pallets have the same general configuration as the prior wooden pallets, but are formed from heavy duty plastic materials, with suitable reinforcements. These molded pallets are more expensive but usually longer lasting than wooden pallets. However, damage from impact by forklift tangs can be severe, since the plastic has less impact resistance than wood, and damaged portions cannot be conveniently replaced or repaired.

A number of different attachments and covers have been developed for forklift tangs for a variety of purposes. For example, Chew in U.S. Pat. No. 2,817,792 describes a plastic cover for forklift tangs to prevent sparking when striking or sliding on concrete, which can be a serious hazard in explosive atmospheres. Adjustable tang covers to aid in precisely stacking pallets, wood stacks and the like are described by Melin in U.S. Pat No. 3,551,628. A tang cover with a sharp wedge-like extension for lifting boxes from a floor is described in U.S. Pat. No. 2,905,349 by Repke.

Attempts have been made to protect pallets from impact damage by padding the leading edge of the tangs. Neuman, as detailed in U.S. Pat. No. 2,282,201, fastens a thick rope in a groove around a rounded tang leading edge. A tang tip cover of resilient material that is slipped over the tang and bolted in place is described by Allen et al. in U.S. Pat. No. 5,221,176. While somewhat helpful, the limited resiliency of these pads is insufficient to protect pallets from impact damage, especially the modern foamed plastic pallets. Further, pads that cover the entire tang provide undesirable thickness below the tang tip, so that the tang tip cannot be lowered to very close to a floor.

Thus, there is a continuing need for improved means for protecting pallets from damage due to impact by forklift tangs, which can be easily and conveniently put on and taken off tangs, does not add excessive thickness, is firmly held in place and resists damage to both a pallet and the tang protective means during impact.

SUMMARY OF THE INVENTION

The above-noted problems, and others are overcome by protective sheaths for forklift tangs which each sheath including a tip bumper including spaced tip protective walls to absorb impact energy, sleeve portions extending from the tip bumper partially down the tang length which add only slight thickness to the tang, a clamp for quickly and positively fastening the sheath to the tang while allowing removal of the sheath as needed. At least one narrow plate-like insert is bonded in an opening in the upper surface of each sheath to aid in preventing sheath slipping of a pallet relative to the sheaths and tangs during carriage of the pallet by a forklift.

Any suitable material may be used for the protective sheath. Plastic materials of the sort having high strength and toughness, impact resistance and, in some portions, low friction characteristics. High impact polyurethane has been found to be optimum for the inserts and the tip bumper area. High density polyethylene has been found to have the optimum combination of strength and low surface friction for major portions of the sheath. While the clamps may be made from any suitable metal or plastic, Nylon 66 has been found to provide optimum characteristics. The protective sheath may have any suitable color. Generally, a high visibility color such as red or yellow is preferred to aid in visibility of the tangs when a forklift is moving while not carrying a pallet.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 2:
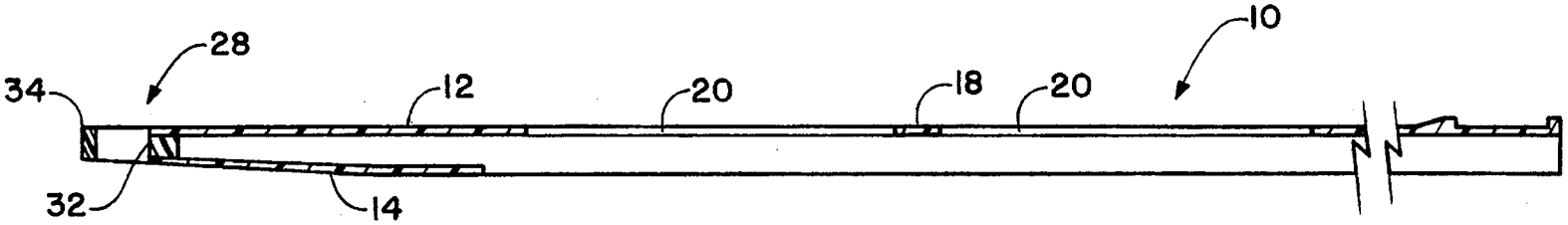
FIG. 2 is a section view taken on line 2—2 in FIG. 1.
Figure 1:
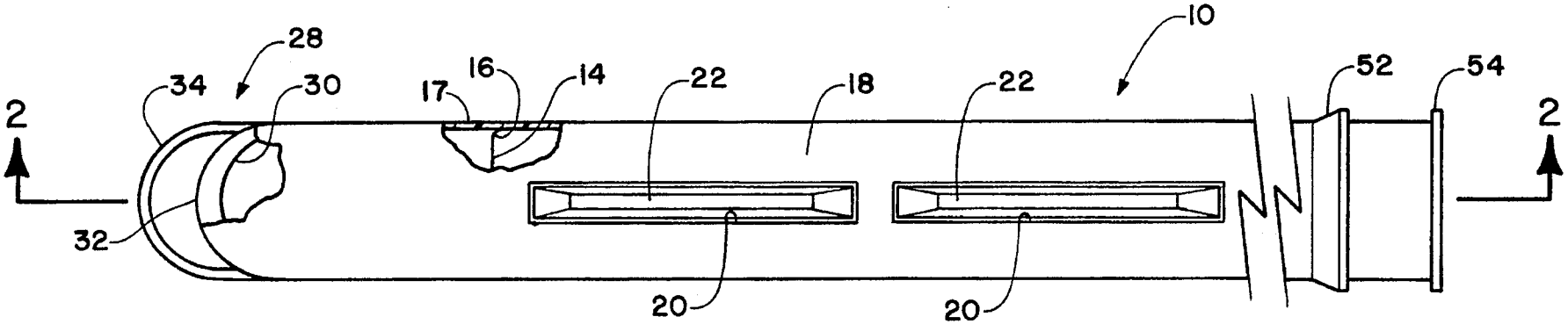
FIG. 1 is a plan view, partly cut-away, of a forklift tang protective sheath of this invention.

Referring to FIGS. 1 and 2, there is seen a protective sheath 10, including a sleeve 12 sized to surround all sides of the end of a conventional forklift tang. Sleeve 12 includes a lower wall portion 14 extending back along the lower tang surface, typically about 8 to 12 inches. Since many tangs have a constant thickness except near the tip where the tang tapers slightly, lower sleeve portion 14 can extend the length of the taper. Preferably, lower portion 14 curves smoothly into the sidewalls 17 of the sleeve as seen at in the side cut-away area of FIG. 1. Upper wall 18 of sleeve 12 extends back along the tang a suitable difference, which will vary with the size and length of the tang. Typically, upper wall 18 may have lengths from about 30 to 48 inches.

Figure 3:
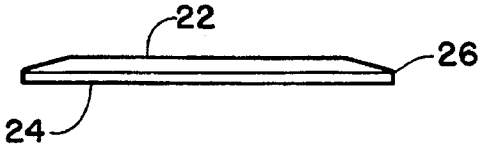
FIG. 3 is an elevation view of a sheath retaining insert.

In order to aid in retaining a pallet in place on the sheaths during carriage by a forklift, protective sheath 10 on the tang, at least one (two, as shown, being preferred) elongated recess 20 is provided in upper wall 18. An anti-slip insert 22, as seen in FIGS. 1 and 3, is positioned in each recess 20 in upper wall 18 and bonded thereto by an adhesive layer 24. The recesses 20 for receiving inserts 22 may have any desired depth and may be openings entirely through wall 18, if desired. The overall thickness of each insert 22 is about three times the thickness of sheath upper wall 18. Vertical end surface 26 preferably has a height approximately equal to the depth of recess 20. Inserts 22 are preferably formed from a high-friction plastic to limit slippage by friction between the inserts and a pallet when the weight of the pallet and . Preferably, sheath 10 is formed from any strong but higher friction plastic material.

A bumper assembly 28 is provided at the end of the tang. The tang end has a curved configuration as indicated by curve 30. Bumper assembly 28 fits against the curve corresponding to the tang end and is overlapped by the sheath walls. As seen in FIG. 1, bumper assembly 28 may have two walls, an inner wall 32 configured to contact a tang end curve 30 and an outer wall 34 spaced from the inner wall. Sheath 10 overlaps the top and side of inner wall 32, with outer wall 34 and the inter-wall open space extending beyond the sheath. This spaced relationship to walls 32 and 34 provides excellent energy absorption should the covered tang end impact a pallet surface or other structure.

Bumper assembly 28 is bonded to sheath 10 in any suitable manner, such as by molding in place, adhesive, ultrasonic or thermal methods. Of these, optimum results are obtained with molding in place. Any tough, resilient, material may be used for bumper assembly 28.

Figure 4:
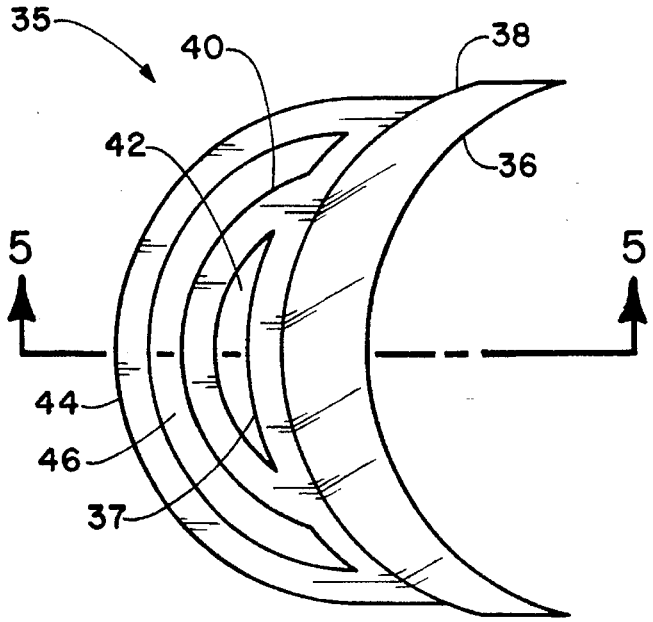
FIG. 4 is a plan view of a bumper insert for the sheath.
Figure 5:
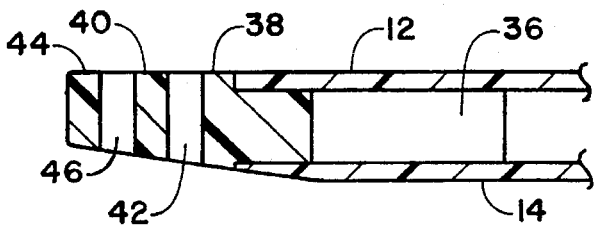
FIG. 5 is a section view taken on line 5—5 in FIG. 4.

An alternate bumper assembly embodiment of 35 is shown in FIG. 4. Inner surface 36 is configured to match the shape of the end of the tang with which the protective cover is to be used. Sheath 10 overlaps and is bonded to a layer 37 on inner wall 38. An intermediate wall 40 extends from inner wall and surrounds a free air space 42. An outer wall 44 is spaced from intermediate wall 40 and provides a second air space 46. Ends of outer wall are attached to layer 37. Preferably, layer 37, intermediate wall 40 and outer wall 44 are molded, such as by injection molding, as a single unitary part which is bonded to inner wall 38. If desired, the entire bumper assembly 35 can be molded as a single unit, then inserted into and bonded to the sheath walls.

Any suitable material may be used for bumper assembly 28. Preferably, the material is a resilient, energy absorbing material. For optimum results a high impact polyurethane, is used.

Figure 6:
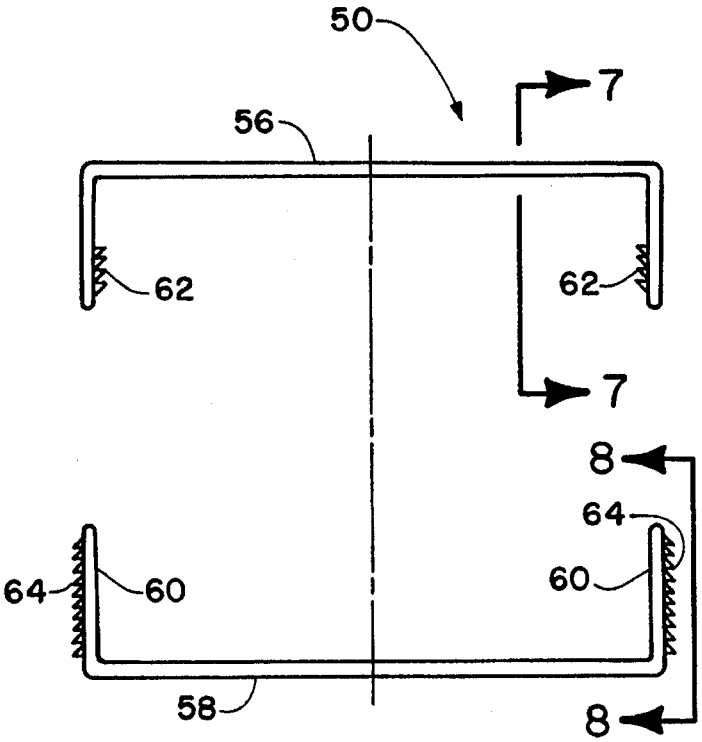
FIG. 6 is an elevation view of the sheath clamp system.
Figure 7:
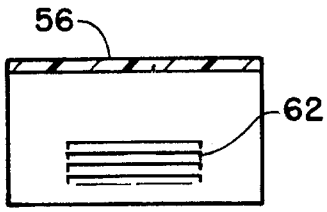
FIG. 7 is a section view of the upper clamp member, taken on line 7—7 in FIG. 6.
Figure 8:
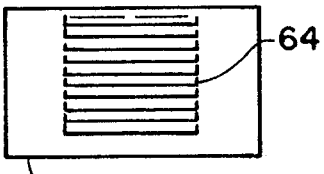
FIG. 8 is a side view of the lower clamp member.

The primal end of sheath 10 is firmly secured to a tang by a clamp assembly 50 as seen in FIGS. 6-8 and cooperating sheath ridges 52 and 54 as seen in FIGS. 1 and 2.

Clamp assembly 50 comprises two generally U-shaped brackets 56 and 58. Bracket 58 fits snugly over the sheath sidewalls 17 and bracket 56 telescopes over the sheath and the legs 60 of bracket 58 to form a generally rectangular band. The brackets are placed between ridges 52 and 54, which prevent bracket slippage along sheath 10. Interlocking spaced ridges 62 and 64, having a generally "sawtooth" cross section on brackets 56 and 58, respectively, are engaged so as to prevent separation of the brackets.

The sheath 10 thus can be easily installed and clamped onto conventional forklift tangs, will be held securely in place during normal forklift operations and will greatly limit any damage to foam plastic pallets and other structures impacted by the distal ends of the tangs.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

We claim:

1. A protective sheath for a forklift tang which comprises:

an elongated sheath having an upper, a lower and two side walls, and an open primal end sized to fit over a forklift tang;

means for reducing slippage of a pallet on a forklift tang;

bumper means at the distal end of said sheath for engagement with a tang end to limit damage to a structure impacted by a tang bearing said sheath;

said bumper means comprising at least two spaced apart elastomeric members generally transverse to said sheath; and clamp means for clamping the primal end of said sheath to a forklift tang.

2. The protective sheath according to claim 1 wherein said means for limiting slippage comprises at least one recess in said upper sheath wall and a coextensive insert bonded in said recess with said insert extending beyond said upper sheath wall.

3. The protective sheath according to claim 1 wherein said bumper means is configured to abut the tang distal end when said sheath is mounted on a tang and said elastomeric members are approximately parallel to said tang distal end.

4. The protective sheath according to claim 1 where said bumper means comprises three spaced elastomeric members.

5. The protective sheath according to claim 1 wherein said sheath walls are formed from high density polyethylene and said bumper is formed from high impact polyurethane.

6. The protective sheath according to claim 1 where said lower wall extends about 8 to 12 inches from the distal end of said sheath and said upper wall extends about 30 to 48 inches from the distal end of said sheath.

7. The protective sheath according to claim 1 wherein said clamp means comprises a first U-shaped member sized to fit over said upper and side walls transverse to said elongated sheath, a second U-shaped member sized to telescope with said first U-shaped member to form a rectangular band and means for locking said telescoped U-shaped members together.

8. The protective sheath according to claim 7 wherein said sheath includes two spaced transverse ridges on at least one of said walls for receiving said U-shaped members therebetween.

9. A protective sheath for a forklift tang which comprises:

an elongated sheath having an upper, a lower and two side walls and an open primal sheath end sized to fit over a forklift tang with said upper wall engaging a tang upper surface;

at least one recess in said upper wall;

an insert sized to fit in said recess;

means for bonding said insert to said upper wall so that said insert will extend beyond said upper wall when said sheath is placed over said tang so as to engage a pallet when mounted on said tangs;

bumper means at the distal end of said sheath for engagement with the distal end of a tang when said sheath is installed thereover;

said bumper means comprising at least two spaced apart elastomeric members generally transverse to said sheath;

two spaced ridges on at least one of said walls;

band clamp means for placement around said sheath between said ridges for clamping said sheath to a forklift tang in said sheath.

10. The protective sheath according to claim 9 wherein said bumper means is configured to abut the tang distal end when said sheath is mounted on a tang and said elastomeric members are approximately parallel to said tang distal end.

11. The protective sheath according to claim 9 where said bumper means comprises three spaced elastomeric members.

12. The protective sheath according to claim 9 wherein said sheath walls are formed from high density polyethylene and said bumper is formed from high impact polyurethane.

13. The protective sheath according to claim 9 where said lower wall extends from about 8 to 12 inches from the distal end of said sheath and said upper wall extends about 30 to 48 inches from the distal end of said sheath.

* * * * *